US008833954B2

(12) United States Patent
Griffin

(10) Patent No.: US 8,833,954 B2
(45) Date of Patent: Sep. 16, 2014

(54) RE-LIGHTABLE RECHARGEABLE GLOW STICKS

(71) Applicant: Calvin Griffin, Honolulu, HI (US)

(72) Inventor: Calvin Griffin, Honolulu, HI (US)

( * ) Notice: Subject to any disclaimer, the term of this patent is extended or adjusted under 35 U.S.C. 154(b) by 0 days.

(21) Appl. No.: 13/784,031

(22) Filed: Mar. 4, 2013

(65) Prior Publication Data

US 2013/0250558 A1 Sep. 26, 2013

Related U.S. Application Data

(60) Provisional application No. 61/613,194, filed on Mar. 20, 2012.

(51) Int. Cl.

| | |
|---|---|
| ***F21V 9/16*** | (2006.01) |
| ***F21V 21/00*** | (2006.01) |
| ***F21L 4/00*** | (2006.01) |
| *F21V 3/04* | (2006.01) |
| *F21Y 101/02* | (2006.01) |

(52) U.S. Cl.

CPC ..... *F21L 4/00* (2013.01); *F21V 3/0436* (2013.01); *F21V 9/16* (2013.01); *F21V 3/0418* (2013.01); *F21Y 2101/02* (2013.01); *F21V 3/04* (2013.01)

USPC ..... 362/84; 362/34

(58) Field of Classification Search

CPC . F21Y 2101/02; F21Y 2113/00; F21Y 23/04; Y10S 362/802; Y10S 362/806

USPC ..... 362/84

See application file for complete search history.

(56) References Cited

U.S. PATENT DOCUMENTS

| | | | | |
|---|---|---|---|---|
| 5,622,423 | A * | 4/1997 | Lee | 362/186 |
| 6,371,625 | B2 * | 4/2002 | Campman | 362/184 |
| 7,252,401 | B1 * | 8/2007 | Plaszcz | 362/84 |
| 7,845,820 | B2 * | 12/2010 | Bertken | 362/217.01 |
| 8,186,846 | B2 * | 5/2012 | Bertken | 362/217.01 |
| 2011/0216533 | A1 * | 9/2011 | Bertken | 362/205 |

* cited by examiner

*Primary Examiner* — Tracie Y Green

(74) *Attorney, Agent, or Firm* — Goodsill Anderson; Walter K. Coronel

(57) ABSTRACT

As disclosed herein, a rechargable glow stick can be constructed from a photoluminescent material and light source. The rechargeable glow stick can be used to repeatedly illuminate a dark environment without continuously expending energy.

8 Claims, 3 Drawing Sheets

RE-LIGHTABLE RECHARGEABLE GLOW STICKS

RELATED APPLICATIONS

This Application claims priority to U.S. Provisional Patent Application No. 61/613,194, filed Mar. 20, 2012, and entitled "RE-LIGHTS RECHARGEABLE GLOW STICKS" by Calvin Griffin, which is incorporated herein by reference.

BACKGROUND

A chemiluminescent device, most commonly known as a "glow stick" is a flexible container including two chemical substances that when mixed produce light. Such an inexpensive, device can temporarily provide light in a dark environment. However, such a device is not reusable. Users must often carry more than one and must dispose of each used device when its chemiluminescence is exhausted. Further, while the chemicals included in the glow stick are typically non-toxic, the chemicals included therein can cause skin irritation, swelling, or even nausea and vomiting, if ingested.

The foregoing examples of the related art and limitations related therewith are intended to be illustrative and not exclusive. Other limitations of the related art will become apparent upon a reading of the specification and a study of the drawings.

SUMMARY

The following examples and aspects thereof are described and illustrated in conjunction with systems, tools, and methods that are meant to be exemplary and illustrative, not limiting in scope. In various examples, one or more of the above-described problems have been reduced or eliminated, while other examples are directed to other improvements.

According to these teachings, an internal light source can charge and re-charge a photoluminescent material. Once charged the light source can be disabled to conserve power and then re-enabled to re-charge the photoluminescent material. The charged photoluminescent material can be used to illuminate a dark environment.

Advantageously, the charge and discharge process can be repeated to allow for continuous illumination without the continuous expenditure of energy. Numerous other features can be incorporated, as described herein.

DETAILED DESCRIPTION

In the following description, several specific details are presented to provide a thorough understanding. One skilled in the relevant art will recognize, however, that the concepts and techniques disclosed herein can be practiced without one or more of the specific details, or in combination with other components etc. In other instances, well-known implementations or operations are not shown or described, in detail to avoid obscuring aspects of various examples disclosed herein.

Figure 1:
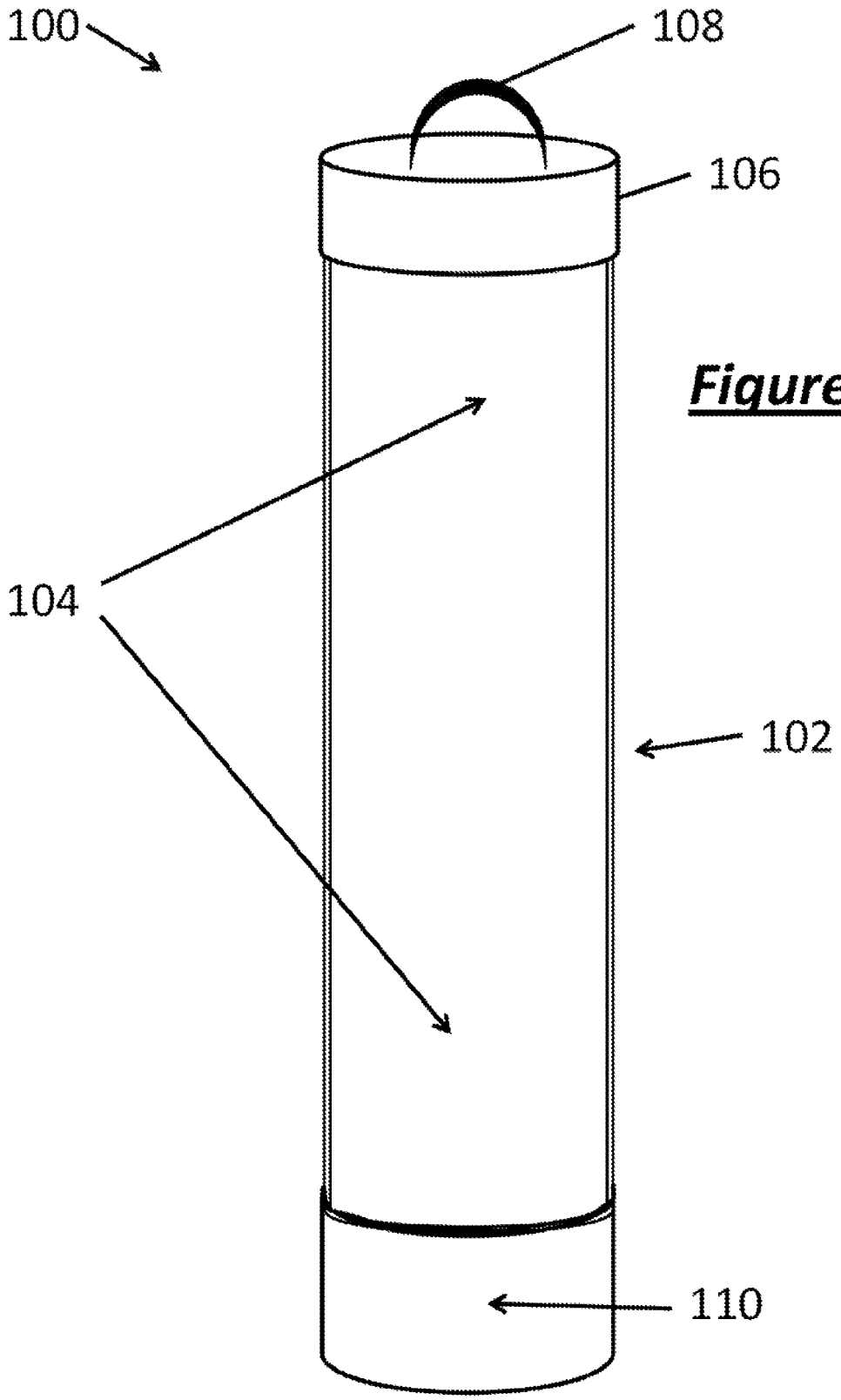
FIG. 1 depicts an example of a rechargable glow stick.

FIG. 1 depicts an example of a rechargable glow stick 100. In the example of FIG. 1, the device 100 includes a clear cylindrical tube 102, photoluminescent material 104, a top cap 106, a handle 108 and a bottom cap 110. Optionally, rechargeable glow stick 100 may also include a solid core (not depicted) to increase the strength of the device and prevent the device from being inadvertently crushed. Additionally, rechargeable glow stick 100 may be encased in a waterproof housing for use under water.

In the example of FIG. 1, a clear cylindrical tube 102 can be formed from a variety of materials, including but not limited to the following plastic, glass, acrylic, resin, or other known or convenient materials.

In the example of FIG. 1, the photoluminescent material 104 can be composed of a variety of flexible materials that may be designed to fit the inner surface of the tube, and which has rechargeable qualities that allow the material to illuminate and radiate lighting over multiple instances.

In the example of FIG. 1, a top cap 106 can be composed of a variety of materials, including but not limited to plastic, glass, rubber, acrylic, resin, or other known or convenient materials, and which can fit tightly over the top end of the tube so as to protect the inner contents of the tube. Such top cap 106 can be coupled to handle 108 for attaching, carrying or otherwise using rechargable glow stick 100. The top cap 106 can be made to be removable to allow light to emanate through the top of the rechargeable glow stick, such as to function as a flashlight as well as a glow stick.

In the example of FIG. 1, handle 108 can be comprised of a variety of materials, including but not limited to plastic, glass, rubber, acrylic, resin, or other known or convenient materials. The handle 108 can be attached to top cap 106 to allow the tube to be transported, attached, or otherwise moved. Such handle can be rigid, flexible, long, short, or otherwise adapted to a particular use or need.

In the example of 100, a bottom cap 110 can be comprised of a variety of materials, including but not limited to plastic, glass, rubber, acrylic, resin, etc., and which can fit tightly over the bottom end of the tube so as to protect the inner contents of the tube. The bottom cap 110 can include a switch allowing a user to charge photoluminescent material 104. Such material can then radiate light for a period of time after the switch is disabled. The bottom cap 110 can house a power source powering the device, for example a battery, electro-mechanical storage device, or other known or convenient energy source.

Figure 2:
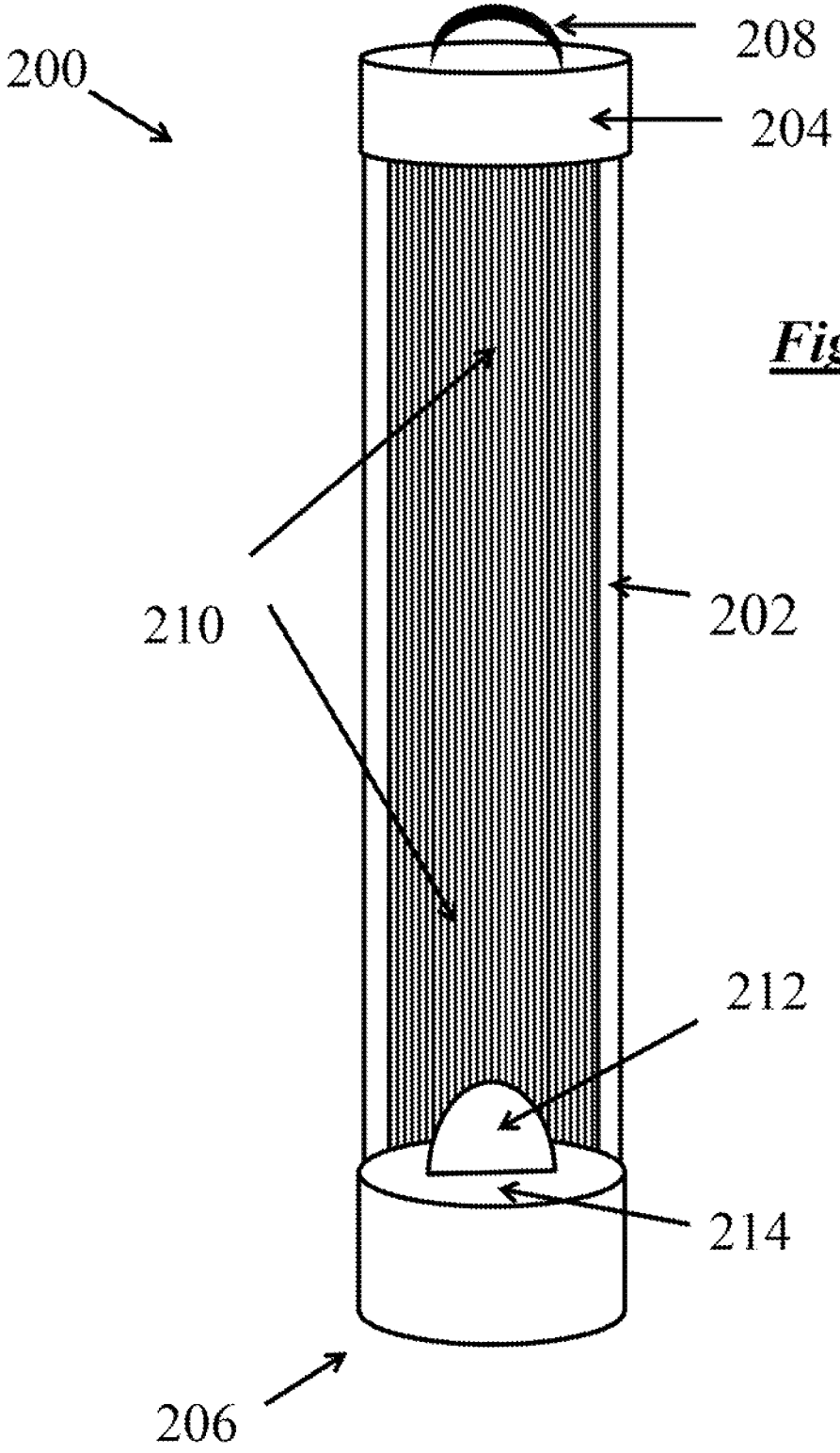
FIG. 2 depicts an example of a cut-away view of a rechargable glow stick.

FIG. 2 depicts an example of a cut-away view of a rechargable glow stick 200, in the example of FIG. 2, the rechargable glow stick 200 includes a clear cylindrical tube 202, a top cap 204, a bottom cap 206, a handle 208, photoluminescent material 210, a light source 212 and a power source 214.

In the example of 200, the clear cylindrical tube 202 can be formed from a variety of materials, including but not limited to the following: plastic, glass, acrylic, resin, rubber, or another known or convenient material. Clear cylindrical tube 202 can be reinforced using a solid core, liquid core, or other known or convenient structure for preventing the device from being crushed under pressure.

In the example of 200, the top cap 204 can be composed of a variety of materials, including but not limited to plastic, glass, acrylic, rubber, resin, or another known or convenient material, and which can fit tightly over the top end of the tube so as to protect the inner contents of the tube.

In the example of 200, the bottom cap 206 can be comprised of a variety of materials, including but not limited to plastic, glass, acrylic, resin, rubber or another known or convenient material, and which can fit tightly over the bottom end of the tube so as to protect the inner contents of the tube. The bottom cap 206 includes a switch allowing a user to control the illumination of the tube. The bottom cap 206 can house the power source of the device within its interior.

In the example of 200, the handle 208 can be comprised of a variety of materials, including, but not limited to plastic, glass, acrylic, rubber, resin, or another known or convenient material. The handle 208 will be attached to the top cap of the tube to allow the tube to be transported, attached, or otherwise moved.

In the example of 200, the photoluminescent material 210 can be composed of a variety of flexible materials that may be designed to fit the inner surface of the tube, and which has rechargeable qualities that allow the material to illuminate and radiate lighting over multiple instances.

In the example of 200, the light source 212 can be selected from a light emitting diode (LED), an incandescent light bulb, a fluorescent light bulb, or any other known or convenient light source which has the capacity to host the passing of an electric current through it until it glows.

In the example of 200, the power source 214 is housed in the bottom cap, and can be activated by a switch on the bottom cap. The power source 214 is controlled by movement of the piece into a certain position causes a battery to come into contact with the bulb such that the bulb illuminates. Such movement can include turning, twisting, depressing, or otherwise actuating the switch in any known or convenient manner.

Figure 3:
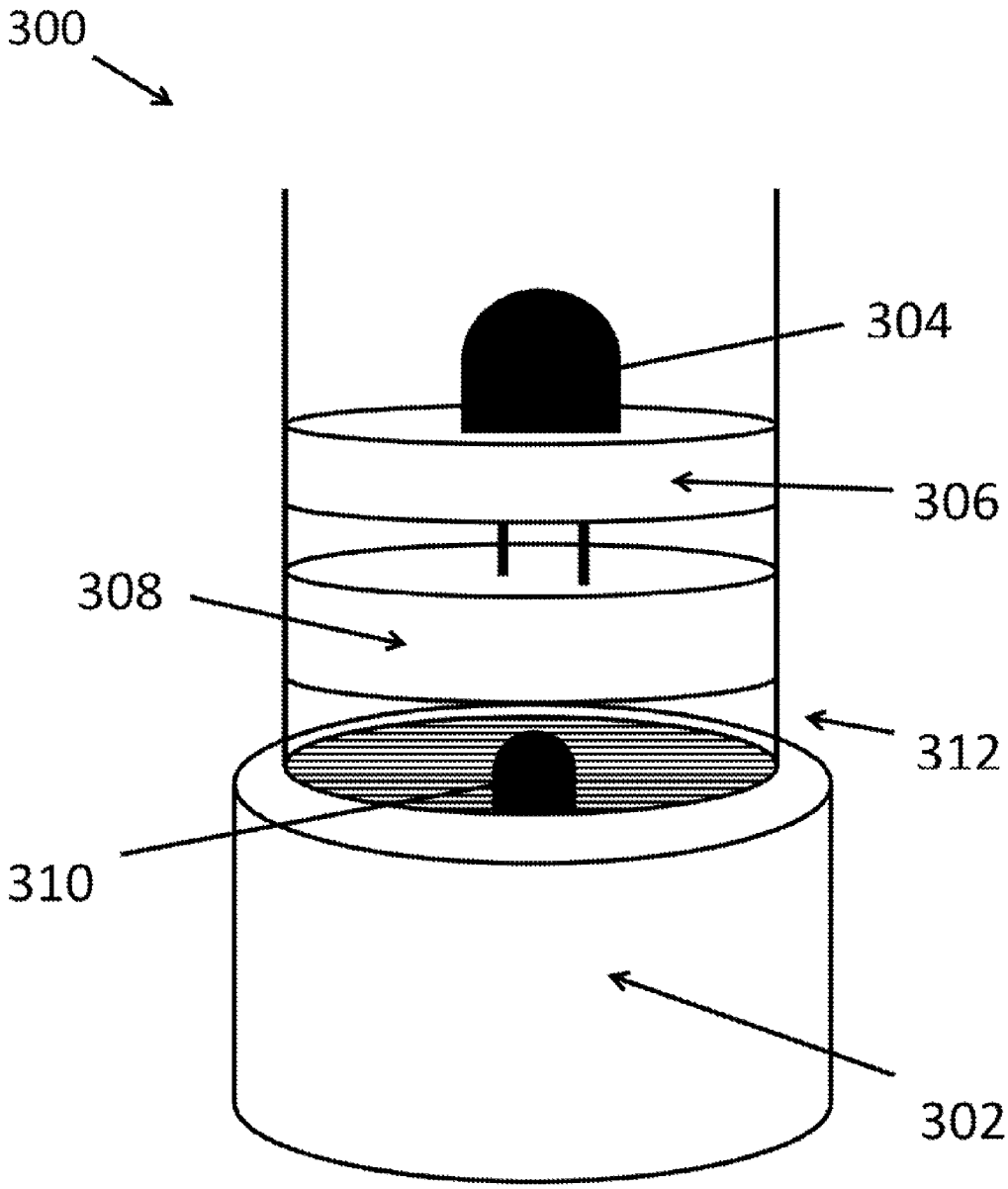
FIG. 3 depicts an example of an exploded view of components in a rechargable glow stick.

FIG. 3 depicts an example of an exploded view of components in a rechargable glow stick 300. In the example of FIG. 3, the rechargeable glow stick 300 includes a bottom cap 302, a light source 304, a socket 306, a power source 308, and a switch 310 and photoluminescent material 312.

In the example of FIG. 3, the bottom cap 302 can be comprised of a variety of materials, including but not limited to plastic, glass, rubber, acrylic, resin, etc., and which can fit tightly over the bottom end of the tube so as to protect the inner contents of the tube. The bottom cap 302 can include switch 310 allowing a user to enable the light source 304. The bottom cap 302 houses within its interior, the power source of the device.

In the example of FIG. 3, the light source 304 can be selected from a light emitting diode (LED), an incandescent light bulb, a fluorescent light bulb, or any other known or convenient light source which has the capacity to host the passing of an electric current through it until it glows.

In the example of FIG. 3, the socket 306 can be a device for coupling the light source 304 to the power source 308. Such a socket 306 can be a socket adapted to the particular light source selected to serve as light source 304, for example, an LED socket, a light bulb socket, a fluorescent light ballast and/or socket or another known or convenient socket.

In the example of FIG. 3, the power source 308 can be one or more electro-chemical cells that convert stored chemical energy into electrical energy, for example a lithium ion battery, alkaline battery, nickel-cadmium battery, or other known or convenient power source.

In the example of FIG. 3, the switch 310 can be a movable piece that is turned, twisted, pressed or otherwise moved into various positions such that power source 308 is electrically connected to light source 304.

In the example of 300, the photoluminescent material 312 can be composed of a variety of flexible materials that may be designed to fit the inner surface of the tube, and which has rechargeable qualities that allow the material to illuminate and radiate lighting over multiple instances.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. An illumination device, comprising:

a cylindrical tube lined along an inner surface of the cylindrical tube with photoluminescent material that illuminates when recharged;

a light source that provides energy to recharge the photoluminescent material within the cylindrical tube; wherein the photoluminescent material radiates light for a period of time after the light source is disabled; and a switch that electrically connects the light source to a power source thereby enabling the light source to recharge the material within the cylindrical tube.

2. The illumination device of claim 1, further comprising a durable, water resistant housing that is transparent in nature such that illumination originating from and produced within the illumination device may pass through and be visible from outside the illumination device.

3. The illumination device of claim 1, further comprising a cylindrical hollow cap fitted over one end of the cylindrical tube, covering the end of the cylindrical tube and including a handle at one end of the cylindrical hollow cap.

4. The illumination device of claim 1, further comprising a cylindrical hollow cap fitted over one end of the illumination device, covering the end of the illumination device and including a moveable switch allowing for control of the illumination of the device.

5. The illumination device of claim 4, wherein the movable switch is enabled by turning the cap.

6. The illumination device of claim 4, wherein the moveable switch is enabled by pressing the cap.

7. The illumination device of claim 1, wherein the power source is a light source housed within the device which transmits energy to the material lining the inner surface of the device.

8. The illumination device of claim 1, further comprising a solid core tilling inside the cylindrical tube; wherein the solid core filling increases the amount of pressure the device can withstand.

* * * * *